US010576520B1

(12) United States Patent
Benedetti et al.

(10) Patent No.: US 10,576,520 B1
(45) Date of Patent: Mar. 3, 2020

(54) APPARATUS AND METHOD FOR THE PRODUCTION OF STRIP

(71) Applicant: DANIELI & C. OFFICINE MECCANICHE SPA, Buttrio (IT)

(72) Inventors: Gianpietro Benedetti, Tricesimo (IT); Paolo Bobig, San Canzian d'Isonzo (IT); Matteo Remy Bulfone, Colloredo di Monte Albano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 16/213,228

(22) Filed: Dec. 7, 2018

(30) Foreign Application Priority Data

Dec. 6, 2018 (IT) ..... 102018000010870

(51) Int. Cl.

| | |
|---|---|
| ***B21B 13/22*** | (2006.01) |
| ***B21B 1/46*** | (2006.01) |
| ***B21B 27/02*** | (2006.01) |
| ***B21B 39/00*** | (2006.01) |
| *B21B 1/32* | (2006.01) |

(52) U.S. Cl.
CPC ..... *B21B 1/463* (2013.01); *B21B 13/22* (2013.01); *B21B 27/021* (2013.01); *B21B 39/004* (2013.01); *B21B 1/32* (2013.01)

(58) Field of Classification Search
CPC .... B21B 1/26; B21B 1/30; B21B 1/32; B21B 1/34; B21B 1/46; B21B 1/463; B21B 1/466; B21B 2013/003; B21B 13/22; B21B 39/004; B21B 39/008; B21B 45/004
See application file for complete search history.

(56) References Cited

U.S. PATENT DOCUMENTS

| | | | | |
|---|---|---|---|---|
| 5,430,930 | A * | 7/1995 | Passoni | B21B 1/466 29/33 C |
| 5,461,770 | A * | 10/1995 | Kimura | B21B 1/466 29/33 C |
| 6,182,490 | B1 * | 2/2001 | Ginzburg | B21B 1/34 72/200 |
| 6,941,636 | B2 * | 9/2005 | Dachtler | B21B 1/466 164/447 |
| 6,978,531 | B1 * | 12/2005 | Che | B21B 1/466 29/527.7 |
| 2002/0104597 | A1 * | 8/2002 | Frank | B21B 37/74 148/541 |
| 2006/0143897 | A1 * | 7/2006 | Thomanek | B21B 1/466 29/527.7 |

(Continued)

FOREIGN PATENT DOCUMENTS

| | | | | |
|---|---|---|---|---|
| WO | 2013/046346 | A1 * | 4/2013 | B21B 1/463 |

OTHER PUBLICATIONS

Translation, WO2013/046346 A1; Apr. 2013.*

*Primary Examiner* — Edward T Tolan
(74) *Attorney, Agent, or Firm* — Panitch Schwarze Belisario & Nadel LLP

(57) ABSTRACT

An apparatus for the hot production of strip (N) including a casting machine (11) configured to cast a thin slab (TS), a heating device (16) configured to maintain the temperature of and/or heat said thin slab (TS), at least one roughing unit (19) and a finishing unit (20) configured to obtain a strip (N), and wherein said casting machine (11), the heating device (16), the roughing unit (19), and the finishing unit (20) are disposed aligned along a common working axis (Z).

12 Claims, 5 Drawing Sheets

(56) References Cited

U.S. PATENT DOCUMENTS

| | | | | |
|---|---|---|---|---|
| 2010/0275667 | A1* | 11/2010 | Seidel | B21B 1/46<br>72/127 |
| 2016/0243602 | A1* | 8/2016 | Benedetti | B21B 1/46 |
| 2017/0002439 | A1* | 1/2017 | Benedetti | B21B 1/466 |

* cited by examiner

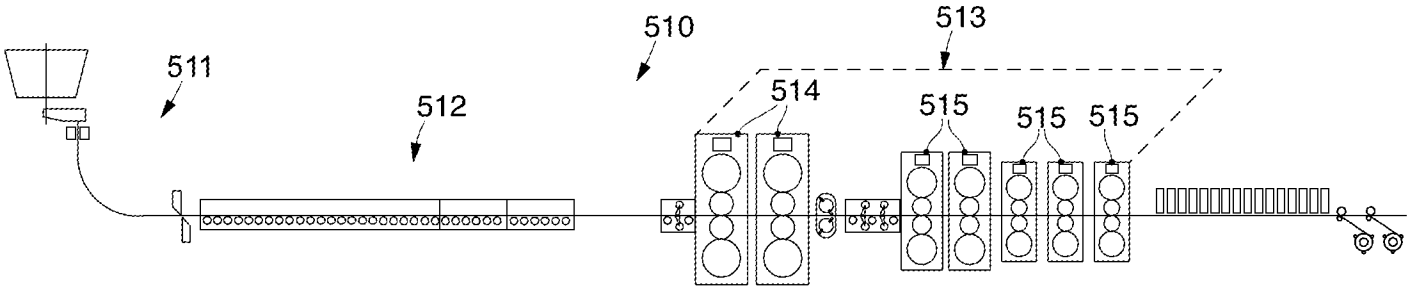
fig. 1 (STATE OF THE ART)
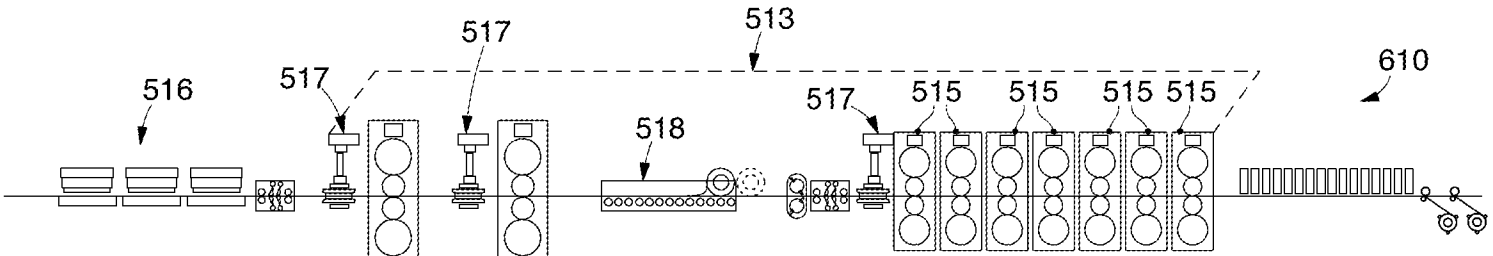
fig. 2 (STATE OF THE ART)
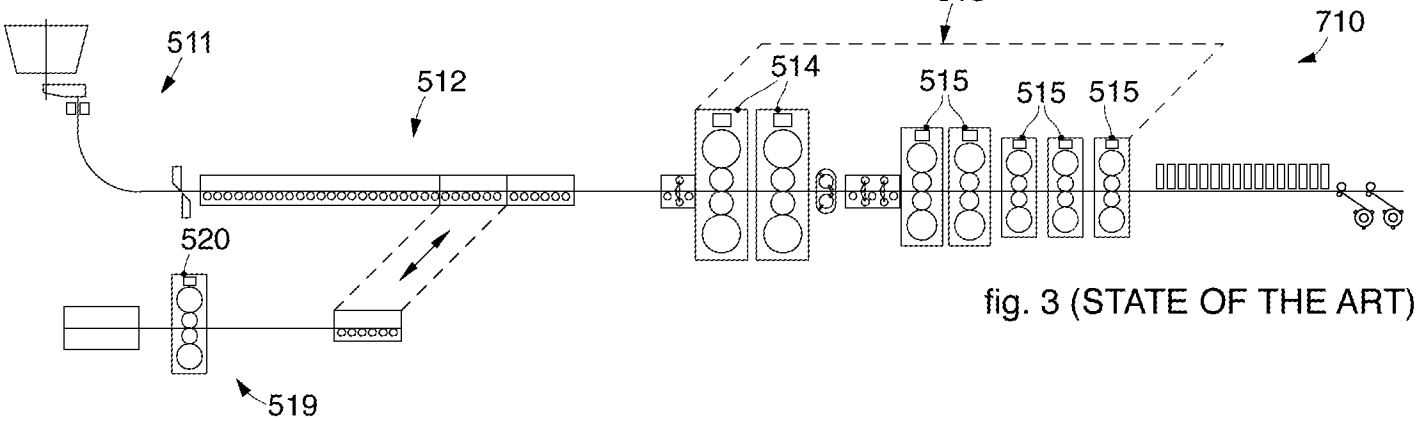
fig. 3 (STATE OF THE ART)

APPARATUS AND METHOD FOR THE PRODUCTION OF STRIP

CROSS-REFERENCE TO RELATED APPLICATION

This application claims priority under 35 U.S.C. § 119(b) to Italian Application No. 102018000010870, filed Dec. 6, 2018, the disclosure of each of which is incorporated herein by reference.

FIELD OF THE INVENTION

The present invention concerns an apparatus and a method for the hot production of strip.

In particular, the apparatus according to the present invention provides to feed both thin slabs and conventional slabs to a rolling line according to the specific requirements of the application. Therefore, the apparatus and the method according to the present invention allow to implement the following operating modes:

- rolling of thin slabs;
- rolling of conventional slabs;
- alternating the rolling of thin slabs and conventional slabs.

Here and hereafter in the description and the claims by the term thin slabs we mean a slab with thickness comprised between 50 mm and 150 mm, preferably between 70 mm and 130 mm. By the term conventional slabs we mean thick slabs comprised between 160 mm and 300 mm, preferably between 180 mm and 250 mm.

BACKGROUND OF THE INVENTION

Apparatuses for the hot production of strip starting from the casting of thin slabs are known.

One example of this apparatus, identified by the number 510, is shown by way of example in FIG. 1.

The apparatus 510 comprises a casting line 511 for thin slabs and a rolling line 513 located downstream and aligned with the casting line 511. A tunnel furnace 512 is normally present directly downstream of the casting line 511 to heat and/or maintain the slabs at a certain temperature before they are rolled.

The rolling line 513 is provided with a plurality of roughing stands 514 and finishing stands 515 disposed in sequence and in which the thin slab is progressively reduced in thickness to obtain, for example, strip.

It is known that some types of materials, for example, steels with particular mechanical and/or chemical characteristics, such as alloy steels, special steels, peritectic steels, stainless steels, are not easily castable as thin slabs, but must be cast with greater thicknesses; for example, the thicknesses of conventional slabs, and therefore would not be workable in the plant as in FIG. 1.

FIG. 2 shows another example of an apparatus, identified by the reference number 610, which is suitable to work conventional slabs. This apparatus comprises a plurality of heating furnaces 516, also called "walking beam furnaces", provided to heat, up to a temperature suitable for rolling, conventional slabs which are at ambient temperature, for example arriving from a storage zone. The heating furnaces 516 are aligned with the rolling line 513 located downstream. The rolling line 513 comprises reversing roughing stands 514, finishing stands 515, and devices 517 for rolling the edges, also called "edgers".

Moreover, between the roughing stands 514 and the finishing stands 515, a winding/unwinding device can be interposed, to wind the rolled product received from the roughing stands 514 and to unwind it and feed it to the finishing stands 515.

Apparatuses for the production of strip are also known which allow to work both thin slabs and conventional slabs which are rolled to obtain strip.

An example of this known apparatus is shown in FIG. 3 with the reference number 710, which comprises a casting line 511 for thin slabs located in line with a tunnel furnace 512, and with a rolling line 513.

The rolling line 513 is provided with roughing stands 514 and finishing stands 515.

The apparatus 510 is also provided with an auxiliary rolling line 519 having a rolling unit 520 configured to roll conventional slabs, which, once pre-rolled by the rolling unit 520 disposed along the auxiliary rolling line 519, are fed laterally to the tunnel furnace 512 to be further rolled in the rolling line 513.

This solution, although it increases the efficiency and productivity of the plant, is very bulky, very costly and difficult to apply to existing plants through operations of renewal and expansion.

Other examples of rolling apparatus are described in documents U.S. Pat. Nos. 6,941,636 and 5,544,408.

One purpose of the present invention is to provide an apparatus for the hot production of metal strip and to implement a method which allows to obtain finished strip having uniform and homogeneous dimensional qualities and mechanical properties for a wide range of steels (steel grade).

Another purpose of the present invention is to provide an apparatus for the production of strip which has limited bulk.

Another purpose of the present invention is to provide an apparatus for the production of strip which has lower investment and maintenance costs compared to known systems.

Another purpose of the present invention is to provide an apparatus and a method for rolling slabs which is easily applicable to existing continuous casting plants.

Another purpose is to perfect a method for the production of metal products with homogeneous qualities starting from both thin slabs and conventional slabs.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an apparatus for the production of strip according to the present invention comprises:

- a casting machine configured to cast a thin slab,
- a heating device configured to maintain the temperature of and/or heat the thin slab,
- at least one roughing unit configured to rough at least the thin slab,
- a finishing unit configured to further roll the slab and obtain a strip.

In accordance with one aspect of the invention the casting machine for thin slabs, the heating device, the roughing unit, and the finishing unit are disposed aligned along a common working axis.

According to another aspect of the invention, the apparatus comprises a lateral feed line adjacent to the working axis and configured to feed a conventional slab, of greater thickness than the thin slab, and a transfer device configured to transfer the conventional slab from the lateral feed line upstream of the roughing unit.

In accordance with another aspect of the present invention the roughing unit comprises at least one roughing stand configured to assume a first operating configuration of one-directional rolling, along the working axis, of the thin slab, and a second operating configuration of two-directional rolling of the conventional slab along the working axis.

Consequently, the roughing stand is the reversing type.

In this way, in the first operating configuration the roughing stand receives the thin slab to be rolled directly from the casting machine. The thin slab is thus moved only in one direction, that is, toward the finishing unit, in order to obtain the metal strip. On the other hand, in the second operating configuration the roughing unit is fed with a conventional slab, which is rolled in the roughing stand, by moving it in the opposite direction, along the working axis.

This solution allows to reduce the complexity of the apparatus compared with known solutions, as well as also allowing to reduce the bulk.

In fact, with the present invention, as well as the roughing unit and the finishing unit located aligned with each other, no additional rolling lines are needed outside the working axis.

The apparatus according to the present invention is able to produce strip starting from a thin slab or from a conventional slab.

Moreover, with the present invention it is possible to work different types of metal, typically steels, increasing the overall flexibility of the apparatus. By way of example only, it can be provided to work traditional steels using the continuous casting machine of thin slabs, while it is possible to work steels with high characteristics if they are fed by the lateral feed line in the form of conventional slabs.

Possible implementations of the present invention also concern a method for the production of strip comprising:

- the casting of the thin slab with the casting machine;
- maintaining the temperature of the thin slab and/or heating it in the heating device;
- the production of a strip by rolling it in the roughing unit and the finishing unit.

In accordance with another aspect of the present invention, the method also provides that the casting, the heating and the production are carried out one after the other, along a common working axis.

The method according to the present invention also comprises:

- feeding the conventional slab with a thickness greater than the thin slab by means of the lateral feed line adjacent to the working axis;
- heating by means of the heating furnace;
- transferring the conventional slab from the lateral feed line to the roughing unit with the transfer device.

According to another aspect of the invention, the method provides that the rolling comprises a roughing step of the thin slab and the conventional slab with the same roughing unit.

The roughing unit comprises at least one roughing stand which assumes a first operating configuration of one-directional rolling, along the working axis, of the thin slab and a second operating configuration of two-directional rolling of the conventional slab along the working axis.

BRIEF DESCRIPTION OF THE DRAWINGS

These and other characteristics of the present invention will become apparent from the following description of some embodiments, given as a non-restrictive example with reference to the attached drawings wherein:

FIGS. 1, 2, 3 are schematic views of apparatuses for the production of strip in accordance with the known state of the art;

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 4:
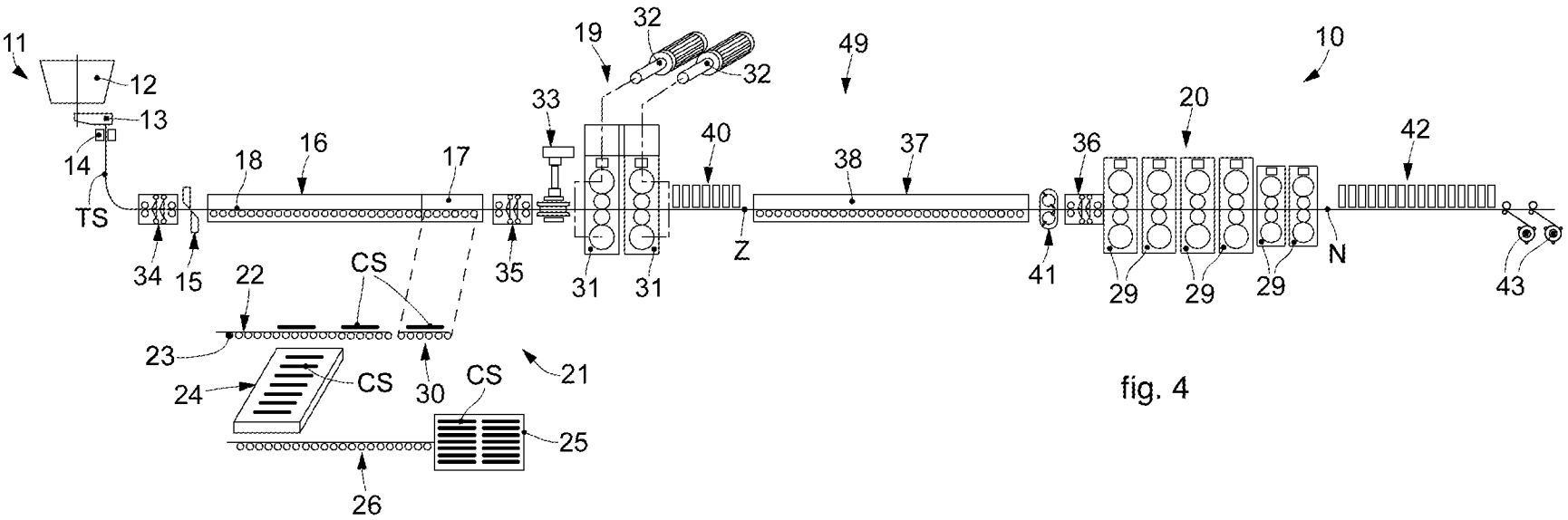
FIG. 4 is a schematic view of an apparatus for the production of strip in accordance with a first embodiment of the present invention.

We will now refer in detail to the various embodiments of the present invention, of which one or more examples are shown in the attached drawings.

Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

With reference to the attached drawings, an apparatus for the hot production of strip N is indicated in its entirety by the reference number 10.

The apparatus 10 comprises a casting machine 11 configured to cast a thin slab TS.

In accordance with one embodiment of the invention, the casting machine 11 comprises a mold 14 configured to cast thin slabs. The mold 14 can be the type with facing and opposite plates and defining a casting cavity in which the liquid metal is introduced and at least partly solidified.

The casting machine 11 can be provided with devices to feed the liquid metal, which in this specific case comprises a ladle 12, and a tundish 13.

The casting machine 11 can comprise liquid core pre-rolling devices, not shown in the drawings, and configured to reduce the thickness of the slab exiting from the mold 14, while its internal part is still in the liquid state, that is, implementing a "soft-reduction".

According to possible formulations of the present invention, a shearing device 15, such as a pendulum shear, is provided immediately downstream of the casting machine 11, to shear the thin cast slabs TS to the pre-set length.

According to some embodiments, the apparatus 10 comprises a heating device 16 configured to maintain the thin slabs TS received from the casting machine 11 at temperature and/or to heat them.

In accordance with possible solutions of the invention, the heating device 16 can comprise a tunnel furnace suitable to maintain the thin slabs TS at temperature and/or heat them.

The tunnel furnace also allows to generate an accumulation buffer for the thin slabs TS with which to manage possible stoppages of the rolling process without particular repercussions on the casting which can thus continue to function for a certain time, also called "buffer-time".

In particular, the buffer capacity of the tunnel furnace 16 prevents interruptions in the casting during programmed maintenance interventions on the parts located downstream of the casting machine 11 or in the event of minor incidents during rolling.

According to possible solutions, the tunnel furnace 16 can have a length comprised between 60 m and 300 m, preferably between 80 m and 250 m. In particular, the length of the tunnel furnace 16 can be set as a function of the buffer time required.

According to one embodiment, the tunnel furnace 16 can be configured to perform a heating of the thin slabs for a predefined length, for example in its first 50-60 m, while in the remaining part only the maintenance of the temperature reached is carried out.

According to another embodiment, the tunnel furnace 16 can be configured to carry out only the maintenance of the temperature reached. In particular, the maintenance-only step is actuated whenever the casting speed is sufficiently high.

By way of example, the temperature of the thin slabs exiting from the tunnel furnace 16 can be comprised between 1050° C. and 1200° C., preferably between 1100° C. and 1150° C.

The tunnel furnace 16 can be provided with a roller way 18 along which the thin slabs TS are moved and, in some embodiments (FIG. 5, FIG. 6), also conventional slabs CS.

In accordance with the embodiments shown in FIGS. 4-11, the tunnel furnace 16 can be provided in its terminal part with a shuttle 17.

The shuttle 17 is selectively translatable in a direction transverse to the casting axis to allow the positioning of other operating components, as described below.

The shuttle 17 can be heated by means of suitable heating devices, which can be the same as those which the tunnel furnace 16 uses.

According to one aspect of the present invention, the apparatus 10 comprises a roughing unit 19 configured to rough at least the thin slab TS arriving from the casting machine 11.

The apparatus 10 also comprises a finishing unit 20 located downstream of the roughing unit 19 and configured to further roll the bar exiting from the roughing unit 19 and obtain the strip N.

The roughing unit 19 and the finishing unit 20 together define a rolling line 49.

In accordance with possible solutions, the finishing unit 20 can comprise a plurality of finishing stands 29 each configured to roll the roughed slab, or bar or transfer bar, supplied by the roughing unit 19.

According to possible solutions, the number of finishing stands 29 can be comprised between 2 and 8, preferably between 4 and 6.

The casting machine 11 for thin slabs TS, the heating device 16, and the rolling line 49 are located in succession to each other along a common working axis Z.

In this way, the thin slab TS, which is cast by the casting machine 11, can be fed directly, that is, without being displaced from the working axis Z, toward the roughing unit 19 and the finishing unit 20.

According to one aspect of the present invention, the apparatus 10 comprises a lateral feed line 21, 121, 221 adjacent to the working axis Z and configured to feed a conventional slab CS, with a thickness greater than the thickness of the thin slab TS.

The conventional slab CS can be made of a material, that is, a steel different from that of which the thin slab TS is made. By way of example only, the conventional slab CS can consist of steel having particular mechanical and/or chemical characteristics with respect to those of the steel of the thin slab TS.

The conventional slab CS can have a length comprised between 5 m and 15 m, preferably between 8 m and 13 m.

In accordance with a possible solution, the lateral feed line 21, 121, 221 can comprise a heating furnace 24 configured to heat conventional slabs CS before they are fed to the roughing unit 19.

In accordance with a possible solution, the heating furnace 24 can be configured to heat the conventional slab CS to a temperature comprised between 1100° C. and 1300° C., preferably between 1150° C. and 1250° C.

The heating furnace 24 can be selected from a group comprising a furnace with movable side members, also called "walking beam furnace", and a furnace with thrusters.

The heating furnace 24 can be provided, in a known manner, with an entrance aperture and a discharge aperture with which loading devices and discharge devices are respectively associated. The loading devices and the discharge devices are configured respectively to introduce the conventional slabs CS into the heating furnace 24 and to discharge them from the heating furnace 24 and toward the lateral feed line 21, 121, 221. The loading and discharge devices can comprise, by way of example only, devices known by the term "kick in" and "kick off".

In accordance with a possible solution of the present invention (FIGS. 4, 7-11), the lateral feed line 21 can comprise a transfer path 22 configured to move the conventional slabs CS out of the heating furnace 24 in a direction parallel to the working axis Z.

The transfer path 22 can comprise a plurality of transfer rollers 23 defining a common movement plane on which the conventional slabs CS are moved.

The heating furnace 24 can be configured to transfer the conventional slabs CS and to feed them to the transfer path 22, in a direction orthogonal to the development of the latter.

According to another embodiment, the lateral feed line 21 comprises a store 25 configured to store a plurality of conventional slabs CS to be subsequently fed to the heating furnace 24.

The lateral feed line 21 also comprises a movement mean 26 located between the store 25 and the heating furnace 24 and provided to move the conventional slabs CS from the store 25 to the heating furnace 24.

In particular, with reference to FIGS. 4, 7-11, the lateral feed line 21 is provided with the store 25 of conventional slabs CS, the movement mean 26, the heating furnace 24 and the transfer path 22.

Figure 9:
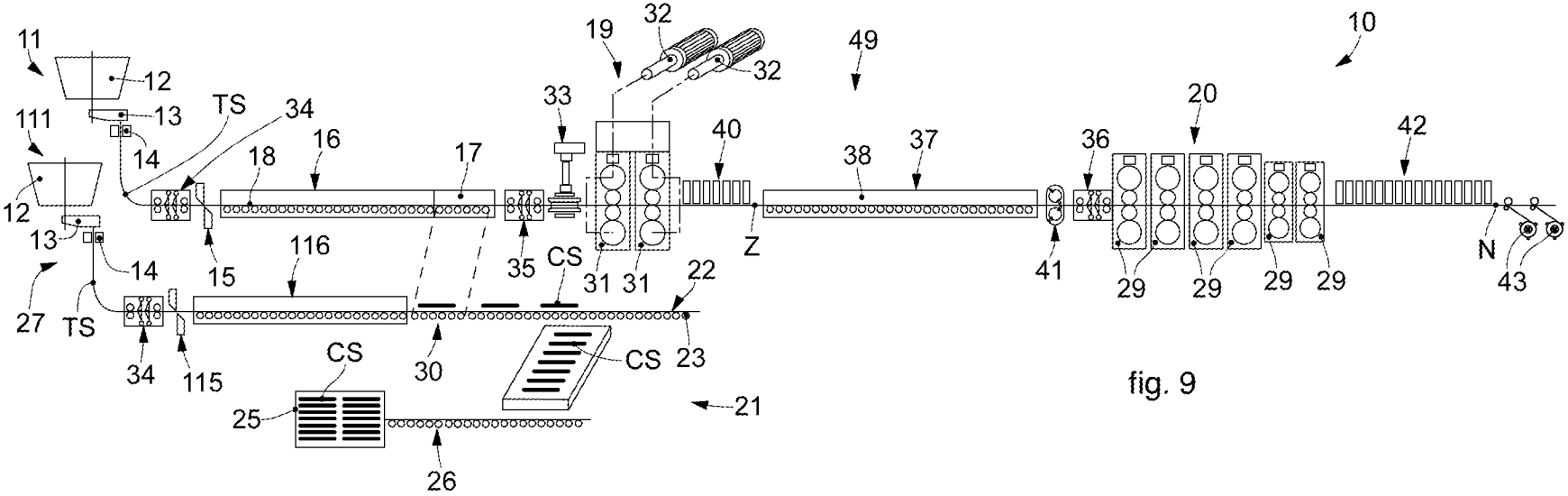
FIG. 9 is another variant embodiment of FIG. 4.

With reference to FIG. 9, the lateral feed line 21 is associated with a second casting line 27 configured to cast thin slabs TS to be fed, subsequently and by means of the same lateral feed line 21, to the roughing unit 19.

The casting line 27 can comprise an auxiliary casting machine 111 substantially similar to the casting machine 11 described above, and provided for casting the thin slab TS.

In particular, the auxiliary casting machine 111 can comprise a ladle 12, a tundish 13, and a mold 14 as described above. Downstream of the auxiliary casting machine 111 a shearing device 115 can be provided, substantially similar to the shearing device 15 described above, configured to shear the thin slabs TS to size.

The casting line 27 can comprise a heating device 116, for example similar to the heating device 16 described above, and configured to maintain the thin slabs TS cast by the casting line 27 at temperature and/or to heat them.

Downstream of the heating device 116, and directly in line with it, there is a transfer path 22, similar to the one described above and provided to feed conventional slabs CS arriving from the heating furnace 24.

Figure 10:
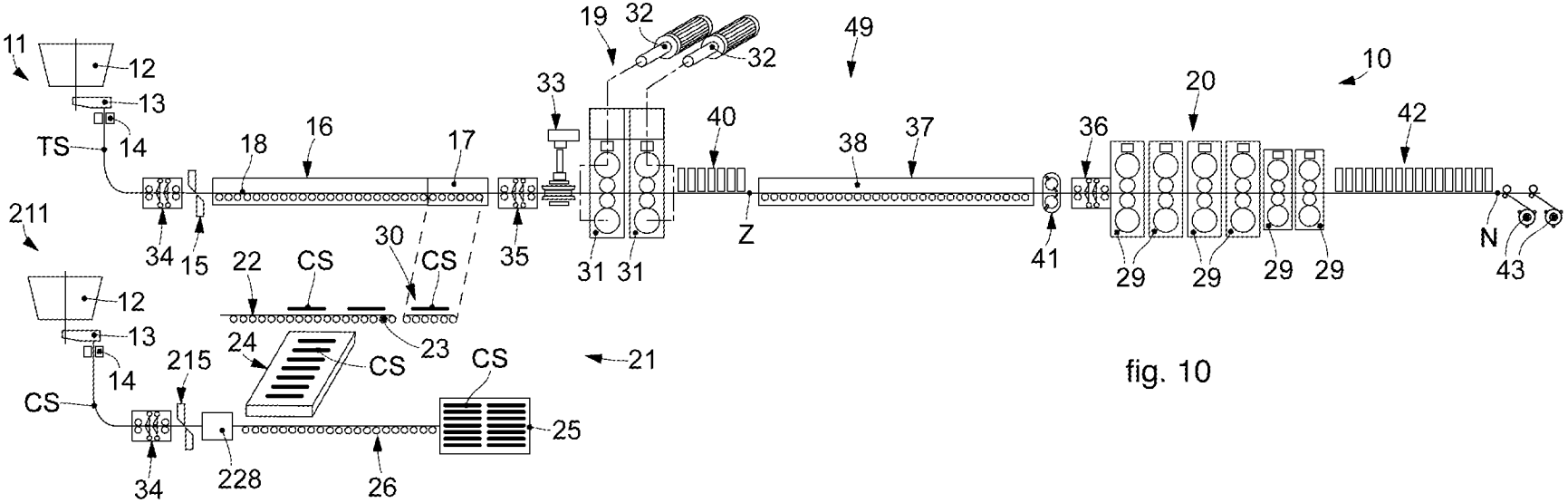
FIG. 10 is another variant embodiment of FIG. 4.
Figure 11:
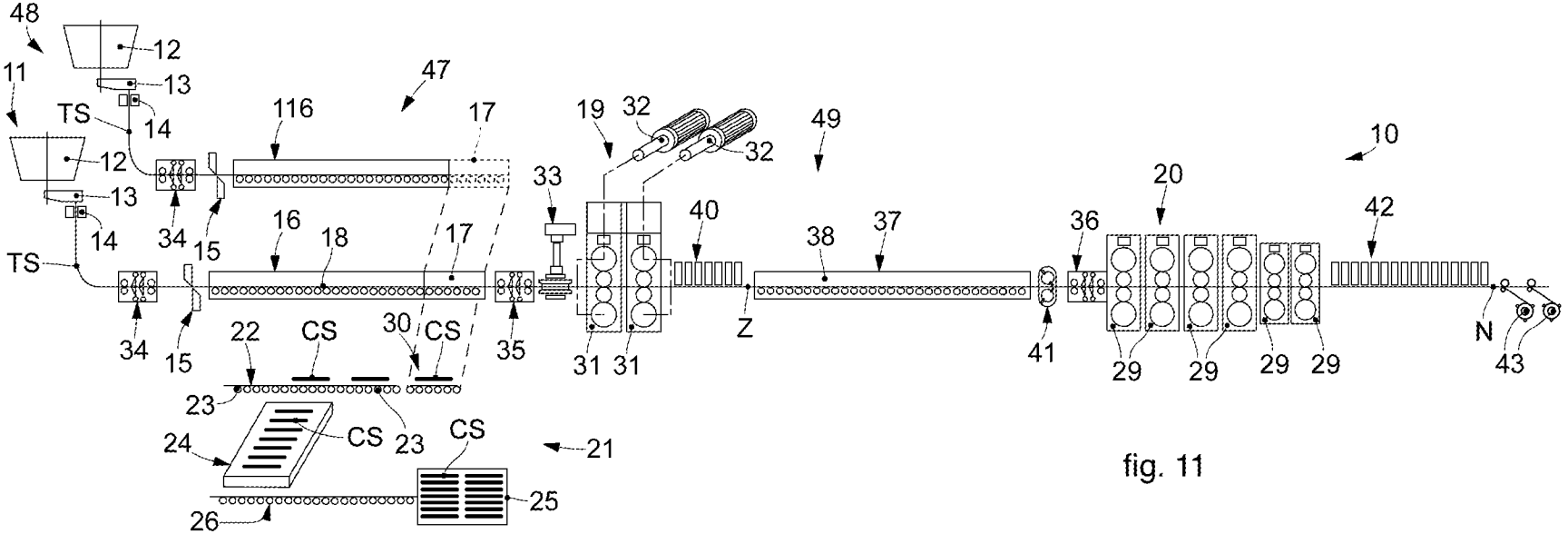
FIG. 11 is another variant embodiment of FIG. 4.

In accordance with the embodiment shown in FIG. 10, the lateral feed line 21 comprises the containing store 25 for conventional slabs CS, the movement mean 26, the heating furnace 24 and the transfer path 22.

Moreover, the lateral feed line 21 comprises a casting machine 211, substantially similar to the casting machine 11 described above and configured to cast conventional slabs CS. Downstream of the casting machine 211 a shearing device 215 is provided, to shear to size the conventional CS slabs supplied by the casting machine 211.

The casting machine 211 is aligned directly with the movement mean 26 to receive the conventional slabs CS sheared by the shearing device 215.

Between the shearing device 215 and the movement mean 26 a deburring member 228 is interposed, provided to deburr the lateral edges of the conventional slabs CS.

According to another embodiment of the invention (FIG. 11) the apparatus can comprise another casting line 47 for thin slabs TS, adjacent to the casting machine 11 and configured to supply thin slabs TS to the roughing unit 19.

The casting line 47 can comprise a casting machine 48 similar to the casting machine 11 described above and a heating device 116 substantially similar to the heating device 16 described above, and located adjacent to it.

The heating device 116 can be provided with a transfer member 117 or shuttle configured to transfer the thin slabs TS from the casting line 47 and position them aligned with the working axis Z.

According to one aspect of the present invention, the lateral feed line 21, 121, 221 comprises a transfer device 17, 30, 130 configured to transfer the conventional slab CS from the lateral feed line 21, 121, 221 to the roughing unit 19.

In accordance with some solutions of the invention (FIGS. 4, 5 and 7-11), the transfer device 17, 30 is mobile between a first position in which it removes the conventional slab CS from the lateral feed line 21, 121 and a second position in which it is aligned with the working axis Z. The transfer device 17, 30 is configured to replace part of, or defines part of the tunnel furnace 16 when it is in the second position.

This solution allows to avoid having segments of the work line located in the air, which not only determine an increase in the length of the plant but also cause temperature losses when operating with the thin slab TS.

In accordance with a possible solution (FIGS. 4, 7-11), the transfer device can comprise a roller table 30 selectively translatable in a direction transverse to the working axis Z to move at least into a feed condition in which it is aligned with the working axis Z.

In accordance with possible solutions of the invention, the roller table 30, in its feed condition, is located directly upstream of the roughing unit 19.

In accordance with possible solutions, the roller table 30, in its feed condition, can be positioned at least partly in, or can replace part of, the heating device 16.

According to some embodiments, the roller table 30 can be selectively positioned instead of the shuttle 17, when the latter is laterally translated as described above, to align itself with the working axis Z.

More specifically, thanks to the fact that the positioning of the roller table 30 is carried out inside the bulk of the tunnel furnace 16 instead of downstream thereof, it is possible not to increase the travel through the air from the exit of the tunnel furnace 16 to the entrance into the first roughing stand 31, thus avoiding temperature losses when operating with the thin slab TS.

In accordance with some embodiments, the roller table 30 is selectively movable between the transfer path 22 and the heating device 16.

The roller table 30 can have a length comprised between 10 m and 40 m, preferably between 15 m and 30 m, or a length at least suitable to contain one of the conventional slabs CS that are fed.

Figure 5:
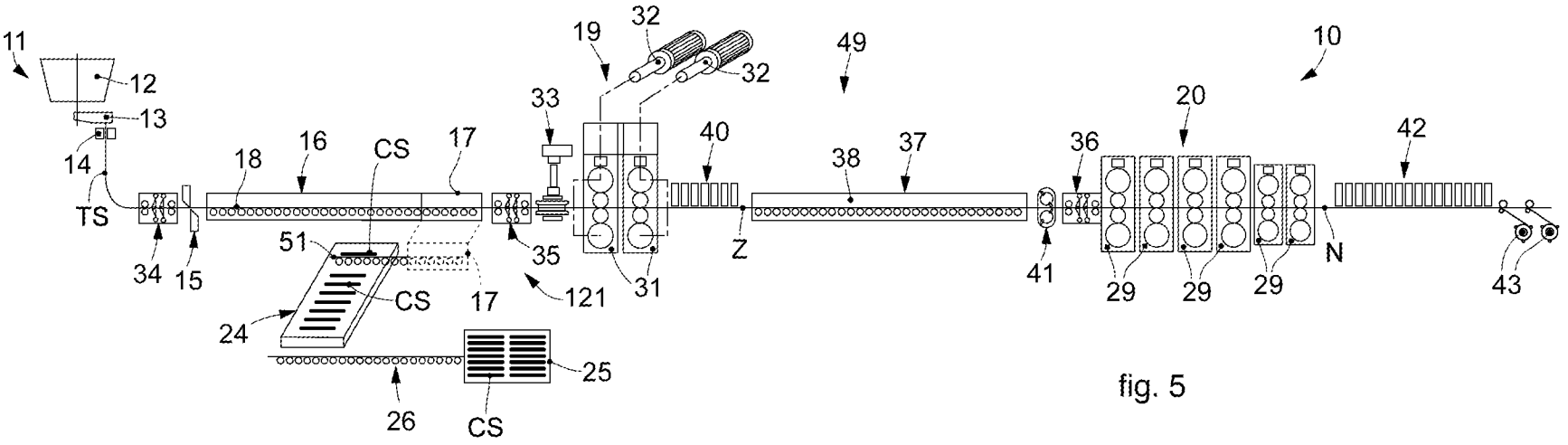
FIG. 5 is a schematic view of an apparatus for the production of strip in accordance with a second embodiment of the present invention.

With reference to FIG. 5, a possible variant embodiment of the present invention is shown.

In accordance with the embodiment in FIG. 5, the transfer device comprises the shuttle 17 as described above, which defines part of the tunnel furnace 16.

Furthermore, FIG. 5 provides a possible variant of the lateral feed line 21 described with reference to FIGS. 4, 7-11, and which is generically indicated by the reference number 121.

The lateral feed line 121 also comprises a heating furnace 24 similar to that described above and configured to heat the conventional slabs CS.

Upstream of the heating furnace 24, the movement mean 26 and the store 25 for storing the conventional slabs CS can be provided, substantially in the same way as that described above.

The heating furnace 24 is provided inside it with a roller feed way 51, to supply the conventional slab CS to the shuttle 17.

In particular, the roller feed path 51 allows to feed the slab axially, that is, on the same longitudinal axis of development as the conventional slab CS, inside the shuttle 17.

In particular, the shuttle 17 is configured to assume a first operating position in which it is aligned with the roller feed path 51 in order to receive the conventional slabs CS from the latter, and a second operating position in which it is aligned with the working axis Z to take the conventional slabs CS onto said working axis Z and then send them to the roughing stand 31. In the second operating position the shuttle 17 is configured to allow the transit of thin slabs TS from the casting machine 11.

In this way, when the rolling line 49 has to work the thin slabs TS arriving from the casting machine 11 the shuttle 17 remains in its condition aligned with the working axis Z, while when conventional slabs CS from the lateral feed line 121 are to be fed to the rolling line 49, the shuttle 17 is alternately mobile between its first and second operating positions so as to remove the conventional slabs CS from the heating furnace 24 and deliver them to the rolling line 49.

Figure 6:
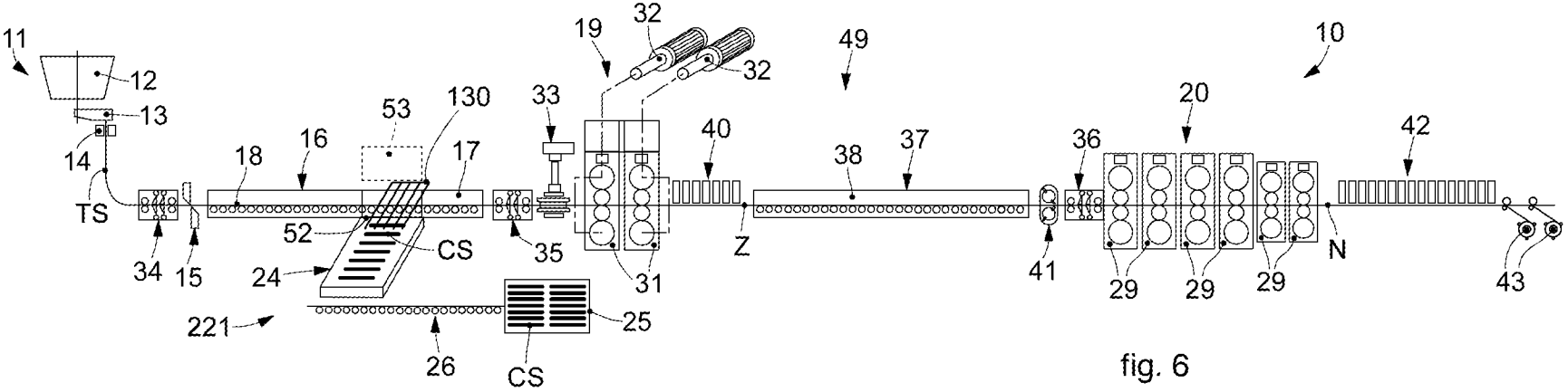
FIG. 6 is a schematic view of an apparatus for the production of strip in accordance with a third embodiment of the present invention.

FIG. 6 shows another variant embodiment of the lateral feed line 21 described with reference to FIGS. 4, 7-11, and which is generically indicated by the reference number 221.

In particular, the feed line 221 comprises a heating furnace 24 provided to feed conventional slabs CS arriving, for example, from a store 25 in ways described above.

The heating furnace 24 is provided with a discharge aperture 52 which can be selectively opened/closed by means of a closing element which has the function of preventing temperature losses of the heating furnace 24.

The discharge aperture 52 faces a portion of the tunnel furnace 16 to discharge the conventional slabs CS directly into the latter. In turn, the tunnel furnace 16 is provided with a loading door 53 which can be selectively opened/closed to allow the introduction of the slab CS on the roller way of the tunnel furnace 16.

For example, the loading door 53 defines part of the cover of the heating device 16 which, in the condition of feeding the conventional slab CS, can be selectively removed for a portion corresponding to the sizes of the conventional slab CS itself.

In correspondence with the discharge aperture 52, a transfer device 130 is provided, and configured to move the conventional slab CS from the heating furnace 24 to the heating device 16.

This movement can be carried out while maintaining the conventional slab CS parallel to the working axis Z.

In accordance with possible solutions, the transfer device 130 can comprise lifting and translation elements, also known as "kick off" elements, although other types of transfer means are not excluded.

According to one aspect of the present invention, the roughing unit 19 comprises at least one roughing stand 31, in this case two roughing stands 31.

According to another aspect of the present invention, the roughing unit 19 is configured to assume a first operating configuration of one-directional rolling, along the working axis Z, of the thin slab TS, and a second operating configuration of two-directional rolling, of the conventional slab CS along the working axis Z.

The roughing stand 31 can be the reversing type, that is, configured to roll, in particular, the conventional slabs CS both in one direction and in the opposite direction, along the working axis Z.

Each roughing stand 31 can be provided with at least one drive member 32 configured to make the roughing rollers of the roughing stand 31 rotate in a clockwise or counterclockwise direction with respect to their axes of rotation, and to move the slab forward or backward and forward along the working axis Z.

In this way, when the roughing stand 31 is used in its first operating configuration, it is possible to feed to it the thin slabs TS supplied directly by the casting machine 11. In this case, the thin slab TS is rolled only once, in a single pass through the roughing stand 31.

When the roughing stand 31 is used in its second operating configuration, the conventional slabs CS, supplied by the transfer device 17, 30, 130, are fed to it, which are rolled at least twice, passing first in one direction and then in the other, along the working axis Z, before being fed to the finishing unit 20.

This allows to obtain a compact, functional and efficient apparatus 10.

Advantageously, the temperature at which the conventional slab CS is removed from the heating furnace 24 is such that no further heating is necessary during reversing rolling.

Consequently, the roughing stand 31 performs a so-called "flat table" reversing rolling in the sense that the conventional slab CS is rolled by the roughing stand 31 back and forth along the working axis Z without the need to wind it in further heating devices or coiler furnaces to control the temperature.

During the movement, in order to roll the conventional CS slab in the direction of the heating device 16 located upstream, the conventional slab CS enters at least partly into the transfer device 30, 17, and remains resting on its rollers.

Thanks to the fact that the transfer device 30, 17 has a length greater than the length of the conventional slab CS which is originally fed, it is possible to prevent the conventional slab in reversing rolling, during its movement toward the heating device 16, from re-entering into said heating device 16.

This prevents any damage to the heating device 16, that is, to its operating components, and prevents any increase in overall sizes, particularly along the working axis Z, of the apparatus 10.

The number of reversing passes of the conventional slab CS in the roughing stand 31 is a function of the initial thickness of the conventional slab CS and of the thickness of bar to be fed to the finishing unit 20.

According to some embodiments, the number of passes of a conventional slab CS inside the roughing stand 31 is at least two, preferably three.

In accordance with possible embodiments of the invention, the apparatus 10 can comprise at least one edge finishing stand 33 configured to laterally linearize the lateral edges of the slabs before they are rolled. This trimming operation improves the quality of the edges of the finished product and increases the yield.

The edge finishing stand 33 can be positioned upstream of the roughing unit 19.

According to one embodiment of the invention, the apparatus 10 comprises at least one descaling device 34, 35, 36, 45 with the function of removing the scale which is generated following the oxidation processes to which the slab is subjected, that is, the bar according to the specific case, because of its high temperature.

In particular, the apparatus 10 can comprise a first descaling device 34 interposed between the casting machine 11 and the shearing device 15.

The apparatus 10 can also comprise a second descaling device 35 positioned upstream of the roughing unit 19, in this case upstream of the edge finishing stand 33.

The apparatus can comprise a third descaling device 36 positioned between the roughing unit 19 and the finishing unit 20.

According to one embodiment of the invention, the apparatus 10 can comprise an intermediate descaling device 45 installed between the edge finishing stand 33 and the roughing unit 19.

According to possible solutions (FIGS. 4-6 and 9-11), the apparatus 10 can comprise a heating unit 37 interposed between the roughing unit 19 and the finishing unit 20 and configured to heat the transfer bar, or bar roughed by the roughing unit 19, and supply it at a suitable temperature to the subsequent finishing rolling.

In accordance with a possible embodiment (FIGS. 4-6 and 9-11), the heating unit 37 can comprise a heated transfer table 38.

According to possible solutions, the heated transfer table 38 can comprise active hoods provided with burners with openable lids to allow the lateral discharge of the bar (with the aid of thrusters) in the event of accidents to the finishing unit 20.

The heated transfer table 38 allows to separate the roughing unit 19 from the finishing unit 20 so as to roll much faster in the roughing unit 19, reducing temperature losses and formation of scale.

The heated transfer table 38 also allows to maintain constant and homogenize the temperature of the roughed bar, or transfer bar, to stabilize the rolling conditions in the finishing unit 20.

According to a variant embodiment (FIG. 7), the heating unit 37 can comprise an induction furnace 39 configured to carry out a rapid heating of the roughed bar, or transfer bar, before it is fed to the finishing unit 20.

Depending on the operating modes described below, the induction furnace 39 can assume an operating condition in which it is aligned with the working axis Z and heats the rough slab, and an inactive condition in which it is displaced laterally with respect to the working axis Z.

According to some embodiments (FIGS. 4-6 and 9-11), a cooling unit 40 can be interposed between the roughing unit 19 and the finishing unit 20, provided to rapidly cool the roughed slab exiting from the roughing unit 19.

This solution allows to confer predefined mechanical properties on the material and is particularly suitable for working particular types of steels, such as steels for pipes.

According to possible solutions, the apparatus 10 comprises at least one shear 41, also called "crop shear" in the specific field, interposed between the roughing unit 19 and the finishing unit 20 and configured to shear the roughed slab, for example when there is an emergency or a blockage in the finishing unit 20, or to shear the head and tail ends of the bar before it is introduced into the finishing unit 20.

In accordance with some embodiments, the apparatus 10 comprises a cooling device 42 located downstream of the finishing unit 20 in order to cool the strip N, before it is wound into coils or rolls.

Downstream of the cooling device 42, the apparatus 10 can comprise winding devices 43, or reels, to wind the strip N.

According to other embodiments of the present invention (FIGS. 7 and 8), a flying shear 44 can be provided directly upstream of the winding devices 43, configured to shear the strip fed by the finishing unit 20 on the fly, in the case of rolling in semi-endless or endless mode.

Figure 7:
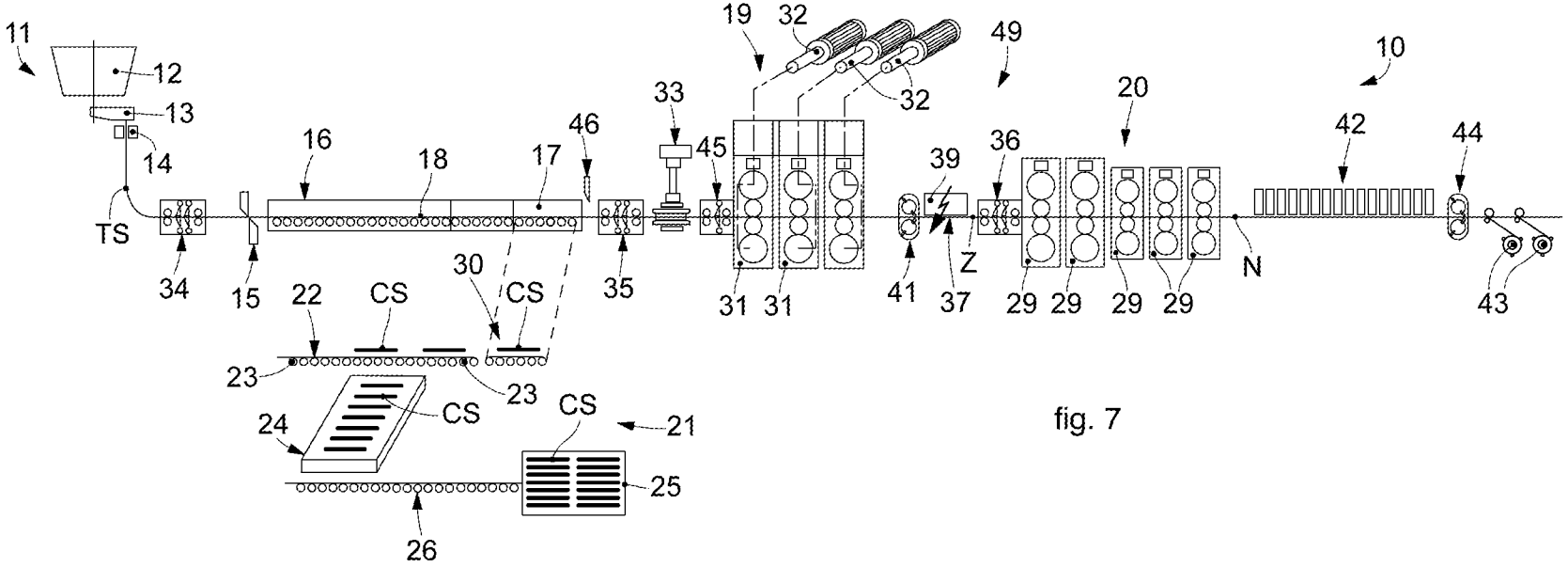
FIG. 7 is a schematic view of another apparatus for the production of strip in accordance with a fourth embodiment of the present invention.
Figure 8:
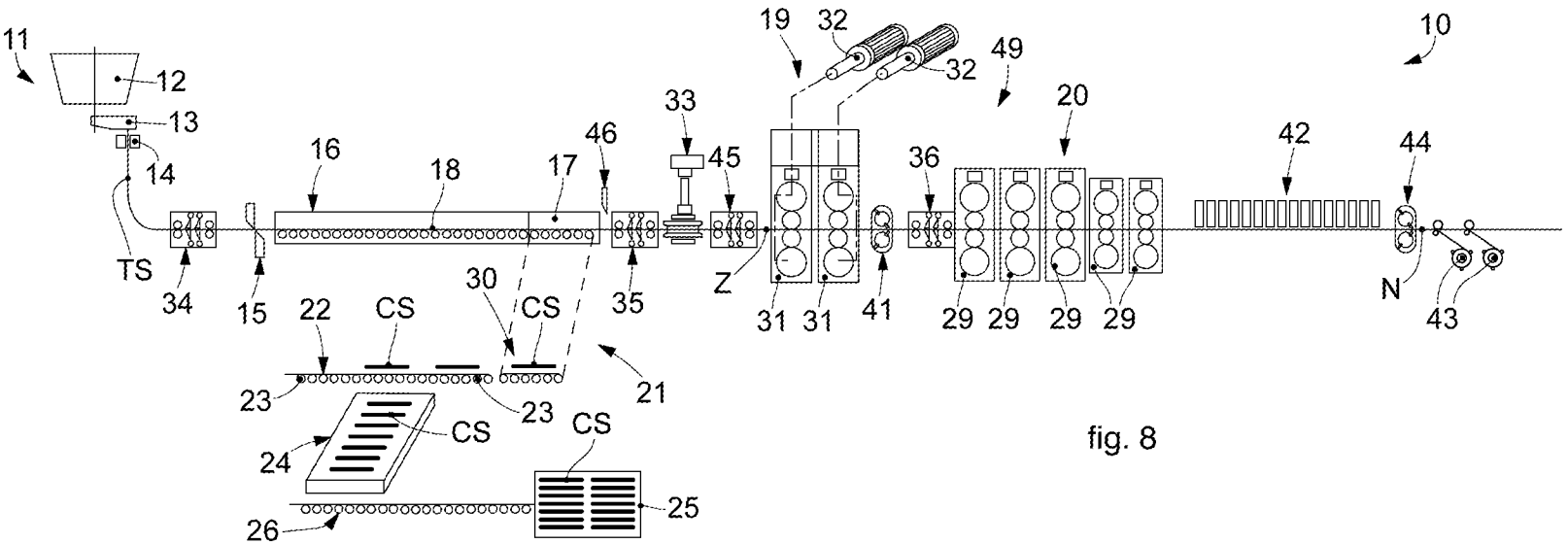
FIG. 8 is a schematic view of another apparatus for the production of strip in accordance with a fifth embodiment of the present invention.

The apparatus 10, according to the embodiments shown in FIGS. 7 and 8, can comprise a shearing element 46, for example an oxy-fuel cutting device, configured to shear, in the event of an emergency, during endless or semi-endless rolling, the slab entering the roughing unit 19.

With reference to the embodiments shown in FIGS. 4-6 and 9-11, the apparatus 10 comprises, disposed in sequence along the working axis Z: the casting machine 11 for thin slabs TS, the first descaling device 34, the shearing device 15, the heating device 16, the second descaling device 35, the edge finishing stand 33, the roughing unit 19, the cooling unit 40, the heated transfer table 38, the shear 41, the third descaling device 36, the finishing unit 20, the cooling device 42, and the winding devices 43.

By way of example only, this constructional layout of the apparatus 10 allows to work thin slabs TS and conventional slabs CS in coil-to-coil mode, that is, in which the length of the slab which is supplied on each occasion to the roughing unit 19 defines the final length of the strip N which is wound in the winding devices, without intermediate cuts. The strip N that can be obtained with this apparatus can have a thickness comprised between 1.2 mm and 25.4 mm.

By way of example only, this constructional layout (FIGS. 4-6 and 9-11) is particularly suitable for the continuous casting of thin slabs TS with a thickness of about 100 mm at exit from the mold 14, and of 90 mm after soft-reduction. The shearing device 15 is configured to shear the thin slab TS by a length equal to the desired roll weight (typically 25-35 m of slab) to perform the rolling in coil-to-coil mode.

The rolling line 49 is in fact configured to work in coil-to-coil mode both when a conventional slab CS is fed and when a thin slab TS is fed.

With reference to the embodiment shown in FIG. 7, the apparatus 10 comprises, disposed in sequence along the working axis Z: the casting machine 11 for thin slabs TS, the first descaling device 34, the shearing device 15, the heating device 16, the shearing element 46, the second descaling device 35, the edge finishing stand 33, the intermediate descaling device 45, the roughing unit 19, the shear 41, the induction furnace 39, the third descaling device 36, the finishing unit 20, the cooling device 42, the flying shear 44, and the winding devices 43.

The roughing unit 19 comprises, in this case, three roughing stands 31.

The finishing unit 20 comprises, in this case, five finishing stands 29.

This constructional layout of the apparatus 10 allows to work in endless mode, in semi-endless mode and in coil-to-coil mode when feeding thin slabs TS, or in coil-to-coil mode when feeding conventional slabs CS.

By way of example only, the apparatus referred to in FIG. 7 can have a thickness of the thin slab TS cast, after soft reduction, of about 110 mm. The shearing device 15 can shear, in coil-to-coil mode, a slab length equal to the desired roll weight (typically 20-28 m) or, in the semi-endless mode, a multiple length from 3 to 5 times.

The induction furnace 39 is activated and taken onto the working axis Z only in the endless work mode.

The flying shear 44 is positioned upstream of the winding devices 43 and is used for working in endless and semi-endless modes.

With reference to the embodiment shown in FIG. 8, the apparatus 10 comprises, disposed in sequence along the working axis Z: the casting machine 11 for thin slabs TS, the first descaling device 34, the shearing device 15, the heating device 16, the shearing element 46, the second descaling device 35, the edge finishing stand 33, the intermediate descaling device 45, the roughing unit 19, the shear 41, the third descaling device 35, the finishing unit 20, the cooling device 42, the flying shear 44, and the winding devices 43.

The roughing unit 19 can comprise two roughing stands 31.

The finishing unit 20 can comprise four or five finishing stands 29.

By way of example only, the constructional layout of the apparatus 10 in FIG. 8 is particularly suitable for working in coil-to-coil and semi-endless mode when feeding thin slabs TS, and in coil-to-coil mode when feeding conventional slabs CS.

By way of example only, the thin slab TS exiting from the mold 14 can have a thickness of about 80 mm, and a thickness of about 65 mm after soft-reduction. The shearing device 15 is configured to shear, in coil-to-coil mode, a slab length equal to the desired roll weight (typically 35-48 m) or, in semi-endless mode, a multiple length from 3 to 5 times. The heating device 16 can have a length of about 240 m.

The roughing unit 19 and the finishing unit 20 define a compact rolling train located one in series with the other and, in this specific case, provided with two roughing stands 31 and four to five finishing stands 29. The flying shear 44 is used only in semi-endless mode. Moreover, this type of layout (FIG. 8) lends itself to semi-endless rolling with a long slab, for example 200 m. Therefore, it is possible to produce strip thicknesses of under 1 mm, for example thicknesses of 0.8 mm.

In all the plant configurations described above, the discharge of the conventional slab onto the main line is advantageously carried out always inside the bulk of the tunnel furnace so as not to lengthen the layout and not to penalize the process thermally when operating with the thin slab.

It is clear that modifications and/or additions of parts can be made to the apparatus 10 and method to produce strip as described heretofore, without departing from the field and scope of the present invention.

It is also clear that, although the present invention has been described with reference to some specific examples, a person of skill in the art shall certainly be able to achieve many other equivalent forms of apparatus 10 and method to produce strip, having the characteristics as set forth in the claims and hence all coming within the field of protection defined thereby.

The invention claimed is:

1. An apparatus for the hot production of strip (N) comprising a casting machine configured to cast a thin slab (TS), a heating device configured to maintain a temperature of and/or heat said thin slab (TS), at least one roughing unit and a finishing unit configured to obtain a strip (N), and wherein said casting machine, said heating device, said roughing unit, and said finishing unit are disposed aligned along a common working axis (Z), the apparatus also comprises a lateral feed line adjacent to said working axis (Z) and configured to feed a conventional slab (CS), of greater thickness than said thin slab (TS), and a transfer device configured to transfer said conventional slab (CS) from said lateral feed line upstream of said roughing unit, wherein said roughing unit comprises at least one roughing stand configured to assume a first operating configuration of one-directional rolling, along said working axis (Z), of said thin slab (TS), and a second operating configuration of two-directional rolling of said conventional slab (CS) along said working axis (Z).

2. The apparatus as in claim 1, wherein said transfer device is mobile between a first removal position of the conventional slab (CS) from said lateral feed line and a second position in which it is aligned with said working axis (Z), and wherein said transfer device is configured to replace part of, or defines part of, said heating device when it is in said second position.

3. The apparatus as in claim 1, wherein said transfer device comprises a roller table selectively translatable in a transverse direction with respect to the working axis (Z) in order to move at least into a condition aligned with the working axis (Z), and upstream of the roughing unit.

4. The apparatus as in claim 1, wherein said transfer device comprises a shuttle defining part of said heating device, and wherein said shuttle is selectively translatable in a direction transverse to the working axis (Z).

5. The apparatus as in claim 1, wherein the lateral feed line comprises a heating furnace configured to heat the conventional slabs (CS) before feeding them to the roughing unit.

6. The apparatus as in claim 5, wherein the heating furnace is configured to transfer the conventional slabs (CS) and feed them to a transfer path, in a direction orthogonal to the transfer path.

7. The apparatus as in claim 5, wherein the transfer device comprises a shuttle and the heating furnace is provided with a roller feed way provided to supply the conventional slab (CS) to said shuttle.

8. The apparatus as in claim 7, wherein said shuttle is configured to assume a first operating position in which it is aligned with said roller feed way to receive the conventional slabs (CS) from said roller feed way, and a second operating position in which it is aligned with the working axis (Z) to take the conventional slabs (CS) onto said working axis (Z) and deliver them to the roughing stand, and wherein in said second operating position said shuttle is configured to allow the transit of said thin slabs (TS) arriving from said casting machine.

9. The apparatus as in claim 5, wherein the heating furnace is provided with a selectively opening/closing discharge aperture, said discharge aperture directly facing a portion of said heating device, and wherein said transfer device is provided in correspondence with said discharge aperture.

10. The apparatus as in claim 5, wherein the lateral feed line comprises a store configured to store a plurality of conventional slabs (CS) to be subsequently fed to the heating furnace.

11. The apparatus as in claim 1, wherein the roughing stand is of the reversing type to roll the conventional slabs (CS) both in one direction and in the opposite direction, along the working axis (Z).

12. The apparatus as in claim 1, wherein the lateral feed line is combined with a second casting line configured to cast thin slabs (TS) to be subsequently fed to the roughing unit.

* * * * *